United States Patent [19]

Carpenter

[11] Patent Number: 5,067,879

[45] Date of Patent: Nov. 26, 1991

[54] PERISTALTIC PUMP SYSTEM

[76] Inventor: Walter L. Carpenter, 1833 Mt. Hope Rd., Grass Lake, Mich. 49240

[21] Appl. No.: 584,144

[22] Filed: Sep. 18, 1990

[51] Int. Cl.[5] ..... F04B 43/12

[52] U.S. Cl. ..... 417/472; 138/119; 138/45

[58] Field of Search ..... 417/474–477; 251/6, 7; 138/45, 119, 173, 177, DIG. 11

[56] References Cited

U.S. PATENT DOCUMENTS

| | | | |
|---|---|---|---|
| 2,406,485 | 8/1946 | Arnold . | |
| 2,925,045 | 2/1960 | Mascaro . | |
| 3,176,622 | 4/1965 | Pfeiffer . | |
| 3,192,863 | 7/1965 | Vadot . | |
| 3,446,247 | 5/1969 | Manning | 138/119 |
| 3,721,269 | 3/1973 | Choate et al. | 138/119 |
| 3,956,544 | 5/1976 | Harrington | 138/119 X |
| 4,131,399 | 12/1978 | Calvet | 417/477 |

FOREIGN PATENT DOCUMENTS

| | | | |
|---|---|---|---|
| 3327669 | 2/1985 | Fed. Rep. of Germany | 417/474 |
| 0061048 | 9/1954 | France | 417/477 |

*Primary Examiner*—Richard A. Bertsch
*Assistant Examiner*—Charles Freay
*Attorney, Agent, or Firm*—Beaman & Beaman

[57] ABSTRACT

The invention relates to a tube for peristaltic pumps wherein rotating members progressively compress the tube to force fluid therethrough for discharging at an outlet end. The tube includes a pair of oppositely disposed longitudinally extending notches or grooves defined in the exterior surface thereof which enhance the flexing characteristics of the tube, permit the flattened cross-sectional area to completely seal with minimal force applied by the rotating members and controls the vacuum pressures generated. The depth and geometric configuration of the notches and the durometer of the tube may be selected to control the compression and expansion characteristics of the tube section to generate and control the desired vacuum or subatmospheric pressure levels for a particular application.

15 Claims, 1 Drawing Sheet

PERISTALTIC PUMP SYSTEM

BACKGROUND OF THE INVENTION

Peristaltic pump systems are commonly utilized in medical applications. For instance, such pumps are often employed during cardiovascular surgery to facilitate circulation of blood between a patient and a heart-lung machine. Other common medical uses are the transfer of blood between a patient and a kidney dialyzer, and intravenous feeding of IV solutions.

Peristaltic pump systems are relatively simple in construction typically consisting of a housing having rollers which progressively compress a flexible tube at spaced intervals against an arcuate surface or raceway so as to flatten or locally reduce the cross-sectional area of the tube. As the rollers continue to roll over the tube, the successive flattened portions expand or return to the original cross-sectional area due to the resilience of the tube which generates a subatmospheric pressure in the tube to draw the fluid therein.

The efficiency of the pump depends on the flexing characteristics of the tube. A tube which completely seals at the flattened cross-sectional area prevents reverse flow of fluid and reflux of air to establish a volumetric pump whereby the rate of flow of fluid ca be accurately calculated by the rotational speed of the rollers. Commercially available peristaltic pump tubes are uniformly cylindrical with a uniform wall thickness and provide a fast recovery rate of the flattened portion to the normal cross-sectional area, however, the shape of the tube produces voids or cavities during expansion and the resiliency of the tube may cause excessive subatmospheric pressures to be created which may draw air into the pump system, or cause damage to the blood and other tissues, which is objectionable.

A variety of tubes incorporating various geometric configurations have been provided in an attempt to provide a more efficient pumping system with relatively little success. For instance, in U.S. Pat. No. 4,131,399 longitudinally extending internal notches or external ridges are provided to prevent the tube from completely occluding which renders the tube useless for many applications and will produce variable vacuum conditions.

U.S. Pat. Nos. 2,406,485 and 3,192,863 incorporate tubes having configurations which reinforce the tube and permit the tube to completely occlude as the rollers pass thereover. However, in U.S. Pat. No. 2,406,485 the tube is provided with an internal notch and a reinforcing external ridge which produces an increased wall thickness and the hose requires special adapters for connecting the tube to standard extracorporeal devices since the tube is not of a circular cross-sectional shape. Also, stretching of the tube, requiring special tools, is necessary during installation which is an inconvenience and is time consuming for the operator. Similarly, the tube in U.S. Pat. No. 3,192,863 incorporates a special configuration including a longitudinally extending fin projecting therefrom which requires additional material to form the tube and a complicated raceway construction for receiving and supporting the same.

It is an object of the invention to provide a tube for peristaltic pumps wherein the tube incorporates a simple construction for optimizing and controlling the flexing characteristics of the tube.

Another object of the invention is to provide a tube for peristaltic pumps wherein the tube is provided with a pair of longitudinally extending notches or grooves defined in the exterior surface thereof for improved control and flexing characteristics and permitting the tube to completely seal with a minimum of strain imparted to the tube.

A further object of the invention is to provide a tube of a generally circular cross-section for peristaltic pump systems wherein the tube incorporates longitudinally extending notches or grooves defined in the exterior surface thereof whereby the depth of the notches and the durometer of the tube may be selected to control the flexing characteristics of the tube and generate the desired negative pressures for a particular application.

A further object of the invention is to provide a tube which is safe for medical applications as excessive negative pressure at the cannulation site is prevented.

Still a further object of the invention is to provide a tube incorporating a pair of external notches or grooves formed by removing material at the areas which would otherwise undergo the greatest strain during compression to prevent the tube from cracking and bursting over extended periods of usage.

Another object of the invention is to provide a tube for peristaltic pump systems wherein the tube incorporates a simple low cost construction which is easily and quickly installed in conventional peristaltic pumps without requiring stretching or special tools.

The tube of the invention is adapted for use in peristaltic pump systems wherein fluid is transferred through the tube by the action of rollers progressively compressing the tube at spaced intervals against an arcuate raceway having an axis common to that about which the rollers rotate. The tube includes an inlet end, an outlet end, and an internal passage extending therebetween. Exteriorly, the tube is provided with a pair of longitudinally extending oppositely disposed notches or grooves defined in the exterior surface thereof.

The notches or grooves are located at the areas of the tube which would otherwise undergo the greatest strain when the tube is compressed, to provide improved flexing characteristics and permit the tube to completely occlude at the locally flattened cross-sectional areas. The geometric configuration and depth of the notches and the durometer of the tube may be selected to optimize the flexing characteristics of the tube during return of the tube to its normal shape to generate the desired negative pressures for a particular application. Because the tube completely occludes, a volumetric pump is established, and no leak passages are created for return or reverse flow of fluid or reflux of air.

The tube is less susceptible to cracking and bursting over extended periods of usage as the material which normally would have undergone the greatest strain has been removed to form the notches. Because the notches are formed exteriorly, the interior of the tube maintains a substantially circular cross-section for easily and conveniently connecting the inlet and outlet ends to standard extracorporeal devices. The simple construction of the tube provides improved efficiency in peristaltic pumps while a low cost construction is maintained.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
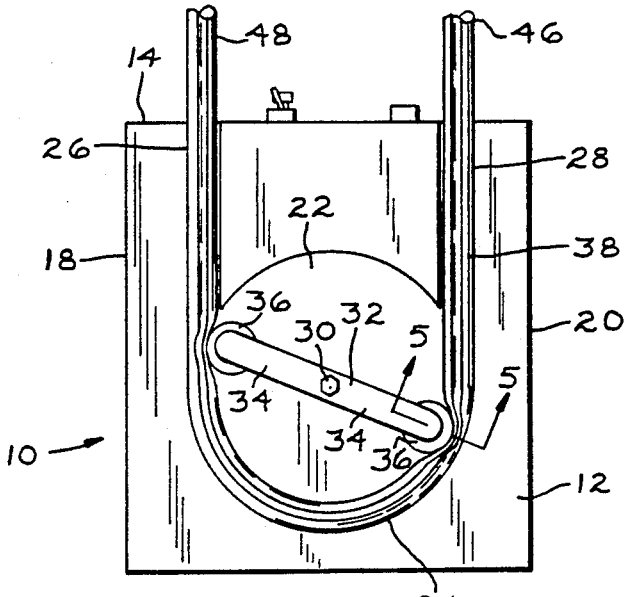
FIG. 1 is an elevational, sectional view of a peristaltic pump system embodying the inventive concepts of the invention.

With reference to FIG. 1, a typical peristaltic pump system utilizing the inventive concepts in accord with the invention is generally indicated at 10. The pump 10 is useful in many industrial and medical applications. For instance, in medical applications the pump 10 may be utilized to circulate blood between a patient and a heart-lung or kidney machine.

The system 10 includes a housing 12 having a front wall 14, a rear wall 16, and opposite side walls 18 and 20. The housing 12 defines an interior chamber 22 having an arcuate surface which forms a raceway 24 tangential to a pair of passages 26 and 28 which intersect the front wall 14. A drive shaft 30 vertically projects into the chamber 22 and drives a rotor 32 having oppositely extending arms 34 which are provided with rollers 36 at the outer ends thereof. Preferably, the drive shaft 30 is driven by a motor, not shown, in the conventional manner.

The pumping system 10 also employs a tube 38 through which the fluid, such as blood, being circulated in the pump 10 is conveyed by action of the rollers 36 progressively compressing the tube 38 against the raceway 24. The geometric construction of the tube 38 incorporates notches or grooves formed in the exterior surface thereof in accord with the inventive concepts to optimize the flexing characteristic of the tube to control pressures therein, as later described, and overcome the deficiencies of prior art tubes commonly utilized in similar pumping systems.

Figure 2:
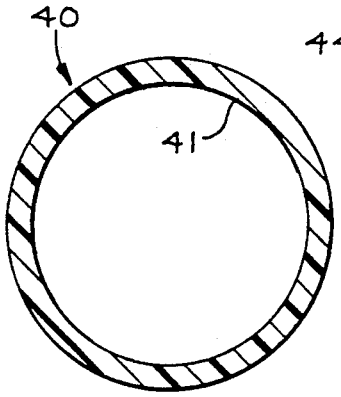
Fig 2 PRIOR ART
FIG. 2 is an elevational, cross-sectional, enlarged view of a conventional prior art tubing commonly utilized in peristaltic pump systems in a non-compressed condition.
Figure 3:
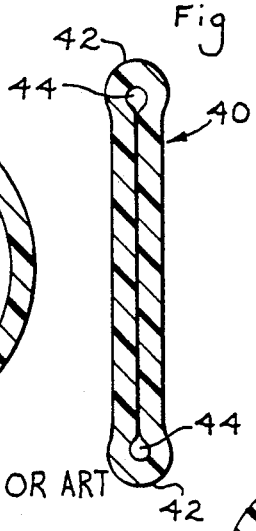
FIG. 3 is an elevational, cross-sectional view of a portion of the conventional tubing of FIG. 2 in a partially compressed condition illustrating the non-occluded passage immediately after compression by the roller.

For purpose of illustration, a typical prior art tube commonly utilized in such pump systems is shown in FIGS. 2 and 3 generally indicated at 40 having at inner diameter 41. The normal cross-sectional shape of the tube 40 in a non-compressed, or at rest, condition is of a circular configuration, FIG. 2. When the tube 40 is compressed by a roller passing thereover the inner bore may be completely closed, but as the roller passes the tube begins to expand and each transverse portion thereof just engaged by the roller and raceway tends to assume the shape of a flattened figure eight, FIG. 3 as the tube starts to resume its shape. The opposite sides of the tube 40 are flattened against each other, but the folds 42 cause the portions of the tube adjacent the folds 42 to rapidly open creating voids 44 which are disadvantageous during pump operation as explained below.

When the supply of fluid to be pumped is less than the capacity of the pump the voids 44 constitute and create a pumping chamber and subatmospheric pressure is generated in the tube which may cause a sufficient vacuum or subatmospheric pressure to be produced which causes air to be drawn into the system at the cannulation site, cavitation of gasses in solutions, and trauma of the tissue in contact with the cannula.

Figure 4:
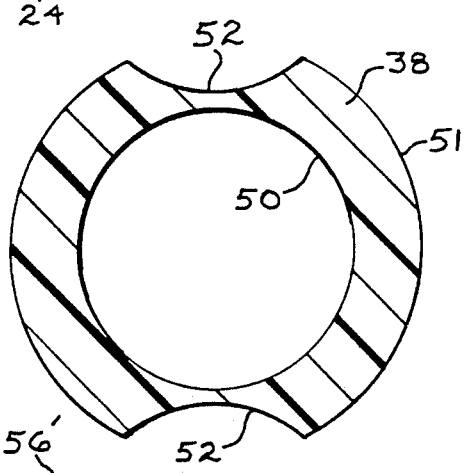
FIG. 4 is an elevational, cross-sectional, enlarged view of a tube embodying the inventive concepts of the invention in a non-compressed condition.
Figure 5:
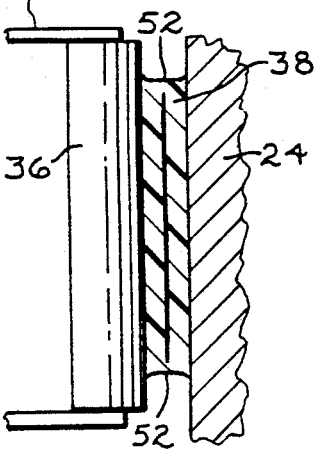
FIG. 5 is an elevational, sectional view as taken along Section 5—5 of FIG. 1 illustrating the completely occluded condition of the tube of the invention when compressed.

Referring to FIGS. 1, 4 and 5, the tube 38 of the invention includes an inlet end 46, an outlet end 48, and a passageway 50 of a generally circular cross-section extending therebetween. Preferably the tube 38 is formed of a resilient plastic or elastomeric material. The inlet end 46 is adapted to be connected to a supply line, not shown, such as a blood supply line in communication with a patient's heart while the outlet end is provided for discharging or returning blood to the patient or to a subsequent component.

Exteriorly, the tube 38 includes a surface 51 and is provided with a pair of oppositely disposed notches or grooves 52 which extend longitudinally along the length thereof. The tube 38 is located within the housing 12 such that the inlet and outlet ends protrude past the front wall through the passage 26 and 28, respectively, and the notches 52 are oriented so that as the tube is compressed the notches define the top and bottom apexes thereof with respect to FIG. 5.

During operation, as the rollers 36 roll over and progressively compress the tube 38 against the raceway 24, the adjacent sides of the tube tend to flatten against one another. The presence of the notches 52 promotes ease of collapse of the tube as the material which would otherwise have undergone the greatest strain has been removed. This permits the passageway 50 to completely occlude with a minimum of force exerted by the rollers a illustrated in FIG. 5. As the roller 36 passes over the tube 38 the locally flattened portions tend to expand and assume the original cross-sectional area of FIG. 4, due to the resilience of the tube. However, the reduced wall thickness resulting from notches 52 "weakens" the tube recovery to its normal shape.

Figure 6:
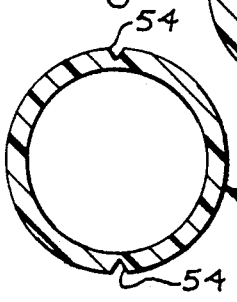
FIG. 6 is an elevational, cross-sectional view of another version of a tube in accord with the invention.

By varying the geometric configuration and depth of the external notches 52 and controlling the durometer of the tube material, the compression and rate of speed at which the tube returns to the original cross-sectional area may be controlled to generate the desired subatmospheric pressures for a particular application. For example, in FIG. 6 a tube 38, is illustrated having a pair of V-shaped notches 54 in accord with the invention, and FIG. 7 illustrates a tube 38" having a pair of notches 56 constructed in accord with the preferred notch form in the practice of the invention.

Figure 7:
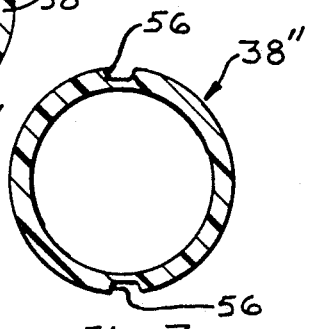
FIG. 7 is an elevational, cross-sectional view of one preferred commercial version of a tube in accord with the invention.
Figure 8:
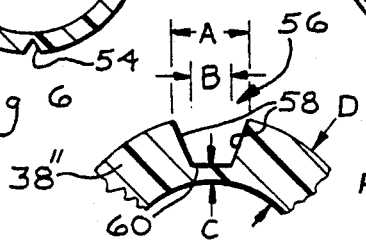
FIG. 8 is an enlarged, detail, cross-sectional view of a notch shown in the embodiment of FIG. 7.

With reference to FIGS. 7 and 8, where the preferred commercial form of the notches is disclosed, the notches 56 each include converging substantially linear sidewalls 58 which each engage a base 60. This preferred form of the invention functions well, and as an example of a commercial form of the inventive concepts the following dimensional relationships exist with respect to the embodiment of FIGS. 7 and 8.

The tube 38" has an internal diameter of 0.375 inches, and a radial wall thickness of 0.100 inches. The circumferential opening of the notches 58 as represented at A is 0.095 inches, while the circumferential dimension of the base 60 is represented at dimension B and is 0.045 inches. The radial depth of the notches 58 is substantially two-thirds of the radial thickness of the tube 38" wherein the radial dimension C separating the base 60 from the tube inner bore is 0.035 inches. These dimensions used with a silicone material tube having a 50 durometer works well. Radiuses of 0.015 inches are formed at the intersection of the notch sidewalls 58 with the base 60 and the exterior surface of the tube.

Figure 9:
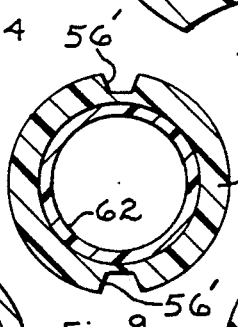
FIG. 9 is a cross-sectional view of a tube in accord with the invention having co-extruded layers of different materials.

FIG. 9 discloses a variation of the invention wherein an inner co-extruded layer 62 is located within the outer layer 38"', which is identical to tube 38". Notches 56' are formed in the tube 38"' identical to those previously described. In the embodiment of FIG. 9 the inner layer 62 may be formed of a special material as to be particularly inert or non-contaminating with respect to the medium being pumped or to impart greater strength for higher pressure applications, and the presence of the notches 56' permits a two layer hose of the type described to have the physical characteristics desired in accord with the inventive concepts wherein the resultant vacuum pressures can be controlled.

In the practice of the invention the use of the notches 52, 54, and 56 closely controls the subatmospheric pressures created as the hose returns to its normal shape after compression by the rollers. By regulating the radial depth and configuration of the notches relatively low subatmospheric pressure can be produced which reduces trauma to the blood cells, reduces trauma to the tissue at the cannulation site and minimizes the potential to aspirate air at the cannulation site. Specific negative pressures can be produced which reduce the likelihood of injuring the patient.

Because the notches permit the tube to fully occlude a volumetric pump is established whereby the flow rate of the fluid can be accurately calculated by the rotational speed of the rollers. The notches 52, 54 and 56 also provide an advantage in that the portion of material which would normally be subjected to the greatest strain is removed which reduces the likelihood of the tube from cracking or bursting over prolonged periods of usage.

The low cost, simple construction of tubes incorporating the inventive concepts provide improved efficiency in peristaltic pumps without adding to the overall cost. As the tubes maintain a circular cross-sectional shape such tubes are conveniently connected to standard extracorporeal components without requiring special tools or stretching which permits the tubes to be easily replaced, when necessary, or spliced into existing pump systems.

It is appreciated that various modifications to the inventive concepts may be apparent to those skilled in the art without departing from the spirit and scope of the invention.

I claim:

1. A flexible resilient tube for peristaltic pumps wherein fluid or gas is propelled through the tube by rotating members transversely progressively compressing the tube at spaced intervals against a raceway, comprising an inlet end, an outlet end, a passage extending therethrough having a surface, an exterior surface, and a pair of longitudinally extending and oppositely disposed notches defined in said exterior surface for enhancing and regulating the flexing characteristics of said tube, said notches having a base, an outer circumferential opening, a radial depth, and inwardly converging side walls.

2. In a tube as in claim 1, said notches being of such radial dimension and configuration as to permit engagement of opposed portions of said passage surface to engage throughout the major dimension of said passage during tube compression.

3. In a hose as in claim 2, wherein said passage is of a uniform circular cross-sectional shape.

4. In a tube as in claim 1, wherein the depth and geometric configuration of said notches are predetermined to control the rate and resiliency of return of the flattened portion to the normal cross-sectional configuration as the rotating members pass thereover to generate a predetermined subatmospheric pressure within said tube.

5. In a tube as in claim 1, wherein said tube is formed of a resilient plastic vinyl material.

6. In a tube as in claim 1, wherein said tube is formed of an elastomeric silicone material.

7. In a tube as in claim 1, wherein the circumferential dimension of said base is approximately one-half circumferential dimension of said outer opening.

8. In a tube as in claim 7, wherein the radial depth dimension of said notches is approximately $\frac{2}{3}$ of the wall thickness of the associated tube.

9. In a tube as in claim 1, an inner flexible resilient liner within said tube.

10. In a tube as in claim 9, said liner comprising a cylindrical tube having a substantially uniform wall thickness.

11. The method of controlling the generation characteristics of subatmospheric pressure produced by a peristaltic pump having a flexible elongated resilient tube having an exterior surface and a radial wall thickness locally radially compressed to a flattened form by a roller longitudinally translated along the tube, comprising the steps of forming a pair of longitudinal extending notches on opposite sides of the tube exterior surface, said notches having a depth extending into the tube wall thickness and a geometric configuration related to the resiliency of the tube to produce a predetermined rate and resiliency of return form the flattened form to generate predetermined subatmospheric characteristics within the tube.

12. The method of controlling the generation characteristics of subatmospheric pressure produced by a peristaltic pump as in claim 11, wherein the step of forming a pair of longitudinally extending notches on opposite sides of the tube include forming the notches with sidewalls intersecting a base wherein the notches include an outer circumferential opening and a radial depth.

13. The method of controlling the generation characteristics of subatmospheric pressure produced by a peristaltic pump as in claim 12, wherein said notches sidewalls are inwardly converging.

14. The method of controlling the generation characteristics of subatmospheric pressure produced by a peristaltic pump as in claim 13, wherein the circumferential dimension of the base is approximately one-half the circumferential dimension of the outer opening.

15. The method of controlling the generation characteristics of subatmospheric pressure produced by a peristaltic pump as in claim 14, the radial depth dimension of the notches being approximately $\frac{2}{3}$ of the wall thickness of the tube.

* * * * *